US006623140B2

(12) United States Patent
Watterson et al.

(10) Patent No.: US 6,623,140 B2
(45) Date of Patent: Sep. 23, 2003

(54) ILLUMINATION DEVICE HAVING MULTIPLE LIGHT SOURCES

(76) Inventors: Scott R. Watterson, 560 S. 1000 E., Logan, UT (US) 84321; Jaremy T. Butler, 8865 S. 300 W., Paradise, UT (US) 84328

( * ) Notice: Subject to any disclaimer, the term of this patent is extended or adjusted under 35 U.S.C. 154(b) by 0 days.

(21) Appl. No.: 09/835,070

(22) Filed: Apr. 13, 2001

(65) Prior Publication Data

US 2002/0149928 A1 Oct. 17, 2002

(51) Int. Cl.[7] ..... F21L 4/02; F21L 4/04
(52) U.S. Cl. ..... 362/184; 362/202; 362/247
(58) Field of Search ..... 362/184, 202, 362/206, 208, 185, 247, 355, 356

(56) References Cited

U.S. PATENT DOCUMENTS

| | | | | |
|---|---|---|---|---|
| 1,394,101 A | | 10/1921 | Little | |
| 1,645,487 A | * | 10/1927 | Harling | 362/184 |
| 1,671,744 A | | 5/1928 | Rosenberg | |
| 2,339,356 A | | 1/1944 | Sachs | 240/10.69 |
| 2,493,205 A | | 1/1950 | Muldoon | |
| 2,599,253 A | | 6/1952 | Gits | |
| 2,900,493 A | * | 8/1959 | Cheng | 362/184 |
| 4,228,484 A | | 10/1980 | Johnstone | 362/184 |
| 4,963,798 A | | 10/1990 | McDermott | 315/312 |
| 5,530,633 A | * | 6/1996 | Yuen | 362/184 |
| 5,558,430 A | * | 9/1996 | Booty, Jr. | 362/184 |
| 6,062,702 A | | 5/2000 | Krietzman | 362/158 |
| 6,086,218 A | * | 7/2000 | Robertson | 362/208 |
| 6,095,661 A | | 8/2000 | Lebens et al. | 362/184 |

FOREIGN PATENT DOCUMENTS

| | | |
|---|---|---|
| GB | 2008237 | 5/1979 |
| GB | 2029559 | 3/1980 |
| GB | 2118290 | * 10/1983 |
| GB | 2242732 | 10/1991 |

OTHER PUBLICATIONS

Product Label for Energizer® Rubber Two Way Flashlight! Area Light!, © 2000, Eveready Battery Company, Inc., Cleveland, OH 44101, 1 Light, 4 AA Size Batts, (2–sided).

Product Label for Energizer® Rubber Two Way Lantern, © 2000, Eveready Battery Company, Inc., Cleveland, OH 44101, 1 Lantern, 4 D Size Batts.

Website Advertisement, www.energizer.com, Energizer® Outdoor products, ©2001 Eveready Battery Company, Inc., Two Way Light, Model #TW420, "Area Light", 1 pg.

Website Advertisement, www.energizer.com, Energizer® Outdoor products, ©2001 Eveready Battery Company, Inc., Two Way Light, Model #TW420, "Spot Light", 1 pg.

Website Advertisement, www.energizerflashlights.com, Energizer® Products, Two–Way Light Model #TW420WB–E and Two–Way Lantern Model #TW450, printed Aug. 13, 2002, 2 pgs.

(List continued on next page.)

*Primary Examiner*—Sandra O'Shea
*Assistant Examiner*—Bao Truong
(74) *Attorney, Agent, or Firm*—Workman Nydegger

(57) ABSTRACT

A flashlight having multiple light sources that may be actuated by a user. A first light source located at or near a first end of the flashlight provides a concentrated, linear beam of light from a head module that is generally parallel with the flashlight when the first light source is actuated. A reflector focuses the beam of light. A second light source in combination with a reflector located a tail module, which is at or near a second end of the flashlight, provides radial illumination with respect to the tail module when the second light source is actuated. The reflector diffuses illumination at the tail module. A switching mechanism enables a user to selectively actuate or deactuate the first and/or second light sources.

40 Claims, 5 Drawing Sheets

OTHER PUBLICATIONS

Website Advertisement, www.energizer.com, Energizer® Outdoor products, ©2001 Eveready Battery Company, Inc., Two Way Lantern, Model #TW450, "Lantern", 1 pg.

Website Advertisement, www.energizer.com, Energizer® Outdoor products, ©2001 Eveready Battery Company, Inc., Two Way Lantern, Model #TW450, "Spot Light", 1 pg.

Website Designs Register Enquiry, http://webdb4.patent.gov.uk, Register Entry for Design No. 2,029,559, Application Date: Mar. 3, 1993, Registration Date: Jun. 24, 1993, 5 pgs.

Website Designs Register Enquiry, http://webdb4.patent.gov.uk, Register Entry for Design No. 2,008,237, Application Date: Jul. 12, 1990, Registration Date: Nov. 21, 1990, 5 pgs.

Versalite, "Dual Lantern Flashlights," on information and belief, available on or about Sep. 2000.

Versalite, "Dual Beam Flashlights," on information and belief, available on or about Sep. 2000.

Eveready® Label, Sport Gear® 2 Way Lantern, © 1996, Eveready Battery Company, Inc., St. Louis, MO 63164.

Eveready® Label, Sport Gear® 2 Way Light, © 1996, Eveready Battery Company, Inc., St. Louis, MO 63164.

* cited by examiner

ILLUMINATION DEVICE HAVING MULTIPLE LIGHT SOURCES

BACKGROUND OF THE INVENTION

1. The Field of the Invention

The present invention relates to an illumination device having multiple light sources that may be actuated by a user. More specifically, the present invention is directed to a flashlight having a first light source located at or near a first end, a second light source located at or near a second end, and a switching mechanism for actuating or deactuating one or more of the light sources.

2. Background and Related Art

Individuals have used various light sources to provide illumination. One light source commonly used is a candle on a candlestick. Once the wick is lit, the candle provides illumination to the surroundings. Multiple candles are lit for increased illumination.

Another commonly used light source is a lamp made of stone, clay, pottery, or metal that holds a flammable fuel that can be burned through a wick to provide illumination. Traditionally the flammable fuel was vegetable or animal oil. More recently, kerosene and propane have been used as the flammable fuel that is burned in the lamp.

The advent of the incandescent and fluorescent lamps provided alternatives that utilize an electrical circuit rather than the use of fire to provide illumination. The incandescent lamp uses an electric current passing through a resistance filament in a vacuum tube to heat the filament until it glows to provide the illumination. Subsequent advancements in the incandescent lamp include filling the tube with a gas. Alternatively, the fluorescent lamp includes a sealed glass tube with an electrode at each end. A small amount of mercury is contained within the tube and the inside surface of the tube is coated with a mixture of fluorescent powders. When an electric current is maintained through the lamp, the mercury becomes vaporized and gives off invisible ultraviolet radiation that is absorbed by the fluorescent coating to emit visible light.

Currently, flashlights are commonly used to provide portable illumination. Typical flashlights utilize an incandescent bulb in combination with a reflector to provide a single, direct beam of light that can be physically pointed in any direction by pointing the flashlight in the desired direction. The beam of light is selectively actuated or deactuated through the use of a switching mechanism that allows a user to close or open an electrical circuit to respectively trigger or halt the beam of light as desired.

Typical flashlights, however, are limited to the use of a light source at the front end thereof, thereby limiting the illumination power of the flashlights to the front end of the flashlights. These flashlights are often difficult to use in a manner other than by holding the flashlight with the user's hand.

For example, if the user desires to illuminate a tent, the user must often hold a typical flashlight because the bottom surface of the tent is typically unstable. Furthermore, even if the flashlight is hand-held, the front end illumination often fails to adequately illuminate objects on the sides of the flashlight.

SUMMARY OF THE INVENTION

The present invention relates to an illumination device having multiple light sources that may be actuated by a user.

More specifically, the present invention is directed to a portable hand-held flashlight having a first light source located at or near a first end, a second light source located at or near a second end to provide radial illumination, and a switching mechanism for actuating or deactuating one or more of the light sources.

Implementation of the present invention includes a switching mechanism that when switched closes an electrical circuit to provide illumination. One electrical circuit that may be closed by the switching mechanism includes one or more light sources located at a tail module. The one or more light sources provide generally radial illumination with respect to the tail module when the one or more light sources are illuminated. Furthermore, the tail module may also include one or more reflectors that diffuse the illumination at the tail module.

Another electrical circuit that may be closed by the switching mechanism includes one or more light sources at an opposing end located at a head module. The one or more light sources are oriented to provide a generally linear beam of light that is generally parallel with the flashlight. A parabolic reflector is employed at the head module to concentrate the illumination into the direct beam of light. The light sources at the head module and/or the tail modules may be bulbs, light emitting diodes, lasers, or any other component or device that is capable of providing illumination.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present invention extends to an illumination device having multiple light sources that may be actuated by a user.

More specifically, the present invention is directed to a flashlight having a first light source located at or near a first end, a second light source located at or near a second end to provide generally radial illumination, and a switching mechanism for actuating or deactuating one or more of the light sources.

In the disclosure, reference is made to a light source that provides illumination. In the disclosure and in the claims the term "light source" refers to any component or device that is capable of emitting light, including a light bulb, a light emitting diode ("LED"), laser, etc., and is an example of a means for providing illumination, which may further comprise a reflector that either concentrates or diffuses the illumination emitted from the light source. Examples of a means for providing generally radial illumination include, without limitation, one or more light sources oriented radially, one or more light sources in combination with one or more reflectors that diffuse the illumination of the one or more light sources, and other examples. Furthermore, while the embodiments illustrated in FIGS. 1–5 correspond to an elongate flashlight, embodiments of the present invention embrace portable, hand-held illumination devices having a variety of different shapes and sizes, a variety of different electrical circuits, and/or a variety of different components to implement the features of the present invention.

Figure 1:
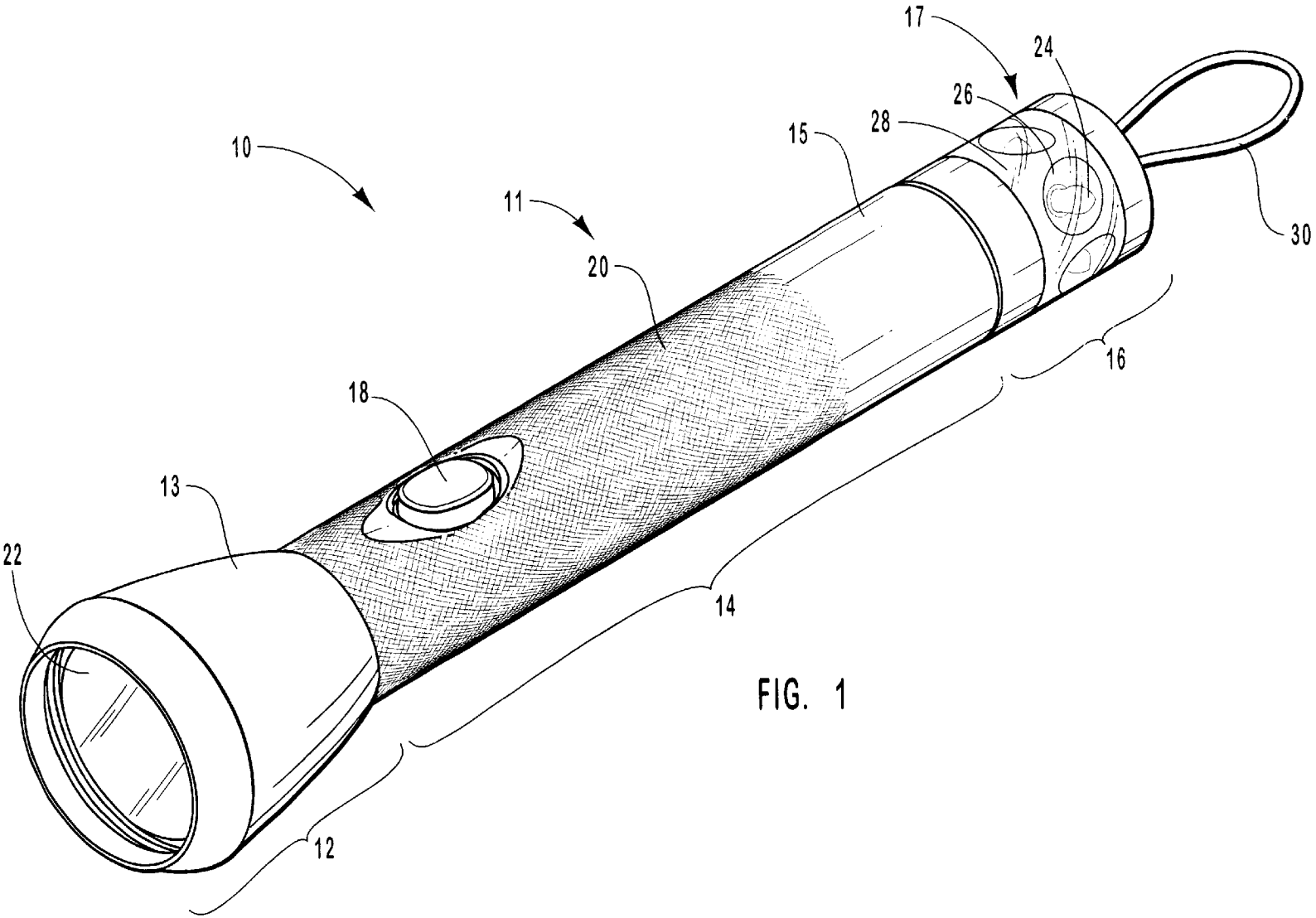
FIG. 1 illustrates a perspective view of an exemplary embodiment of the present invention.

With reference to FIG. 1, a perspective view is illustrated of an exemplary embodiment of the present invention illustrated as flashlight 10. Flashlight 10 comprises a housing 11, which houses a power source, one or more light sources, a switch, and a variety of other components as desired. Housing 11 is preferably comprised of three selectively coupled housing portions 13, 15, and 17, which house selected components. Each housing portion is part of a module. Housing 11 serves as an example of a means for containing a power source and at least one light source electrically coupled thereto. Housing 11 can also comprise a variety of other components.

While the combination of housing portions 13, 15 and 17 provides an example of a means for containing that comprises three portions, other examples of means for containing may comprise more than three or less than three portions (e.g., one or two portions).

The housing portion may comprise a variety of different matters. For example, housing portions 13, 15 and possibly elements of housing portion 17 may comprise a conductive material, such as a metal. Also, housing portion 17 may comprise a transparent or translucent lens. In a further embodiment, the portions 13, 15 and possibly elements of housing portion 17 comprise aircraft-grade aluminum. Other embodiments of the present invention embrace housing portions 13, 15, and/or 17 that comprise a non-conductive material, such as plastic. When the housing comprises a non-conductive material, changes may be required to the electrical circuit shown in FIGS. 1–4 so as to make the circuit completely internal in relation to the non-conductive housing, as will be appreciated by those skilled in the art in light of this disclosure.

As mentioned, each housing portion 13, 15, 17 is part of a module. In FIG. 1, flashlight 10 comprises a head module 12, a tail module 16, and an elongate handle module 14 interposed therebetween.

As illustrated in FIG. 1, head module 12 comprises housing portion 13 and a lens 22 through which a beam of light is emitted from a light source within housing portion 13. Lens 22 may comprise any transparent or semi-transparent material, such as glass, plastic, etc. In one embodiment, lens 22 is a polycarbonate lens that is shatter-proof and scratch resistant. Furthermore, a polycarbonate lens provides optical clarity for a pure lighted view. A reflector is positioned about the light source so as to assist in directing the light into a generally linear beam and is an example of a means for concentrating the illumination. The reflector may comprise a variety of different materials that may be used in projecting a direct beam of light in a generally linear direction. In one embodiment, the reflector is a parabolic reflector to maximize the concentration of the beam of light.

The light source at the head module 12 is actuated or deactuated by a user utilizing a button 18 that covers a switch, which is an example of a means for selectively actuating, as will be further explained below. In addition, as provided above, the light source may be any component or device that is capable of emitting light, such as a light bulb, an LED, a laser, etc. In the illustrated embodiment, button 18 is a rubber cap covering a switch that can be employed by the user to actuate or deactuate one or more light sources. As will be appreciated by those of skill in the art, a variety of switches or buttons may be used, including a toggle switch, an electronic switch, etc.

In the illustrated embodiment, each of the light sources at tail module 16 is oriented radially with respect to the tail module housing 17 to thereby radially emit illumination from tail module 16. In another embodiment, the tail module comprises one or more light sources in combination with one or more reflectors that diffuse the illumination from the one or more light sources, as will be further explained below. Both embodiments are examples of a means for providing generally radial illumination.

As illustrated in FIG. 1, a light source (e.g., light source 24) at tail module 16 has a reflector (e.g., reflector 26), positioned thereabout to assist in providing generally radial illumination through a lens (e.g., lens 28). The reflector may comprise a variety of different shapes so as to produce generally radial illumination, such as a conical shape, a wedge shape, etc. Furthermore, a reflector that diffuses the illumination is an example of a means for diffusing and a reflector that focuses the illumination is an example of a means for concentrating. While the embodiment of FIG. 1 may comprise six light sources (e.g., six light bulbs) oriented radially with respect to tail module housing 17 for providing generally radial illumination, other embodiments of the present invention embrace more than six light sources or less than six light sources that provide generally radial illumination. Furthermore, embodiments of the present invention embrace light sources used at the tail module and at the head module that are interchangeable, as will be further explained below.

Flashlight 10 may comprise a grip 20 to facilitate holding handle module 14, and grip 20 is an example of a means for gripping. As shown, certain radial illumination provided from the tail module is transverse to a longitudinal axis of the grip. In the illustrated embodiment, grip 20 is illustrated as having a knurled surface located on housing portion 15 about button 18, and extending to head module 12. Alternatively, flashlight 10 may be suspended on a hook or a branch rather than being held at handle module 14 and therefore may comprise a hanger 30 to facilitate the suspension of the flashlight 10. A component that allows flashlight to be suspended, such as hanger 30, is an example of a means for suspending. In the illustrated embodiment, hanger 30 is a resilient cord coupled to an end of the tail module 16 that comprises metal, plastic, rubber, or another material to form a dynamic loop that facilitates suspending flashlight 10.

Figure 2:
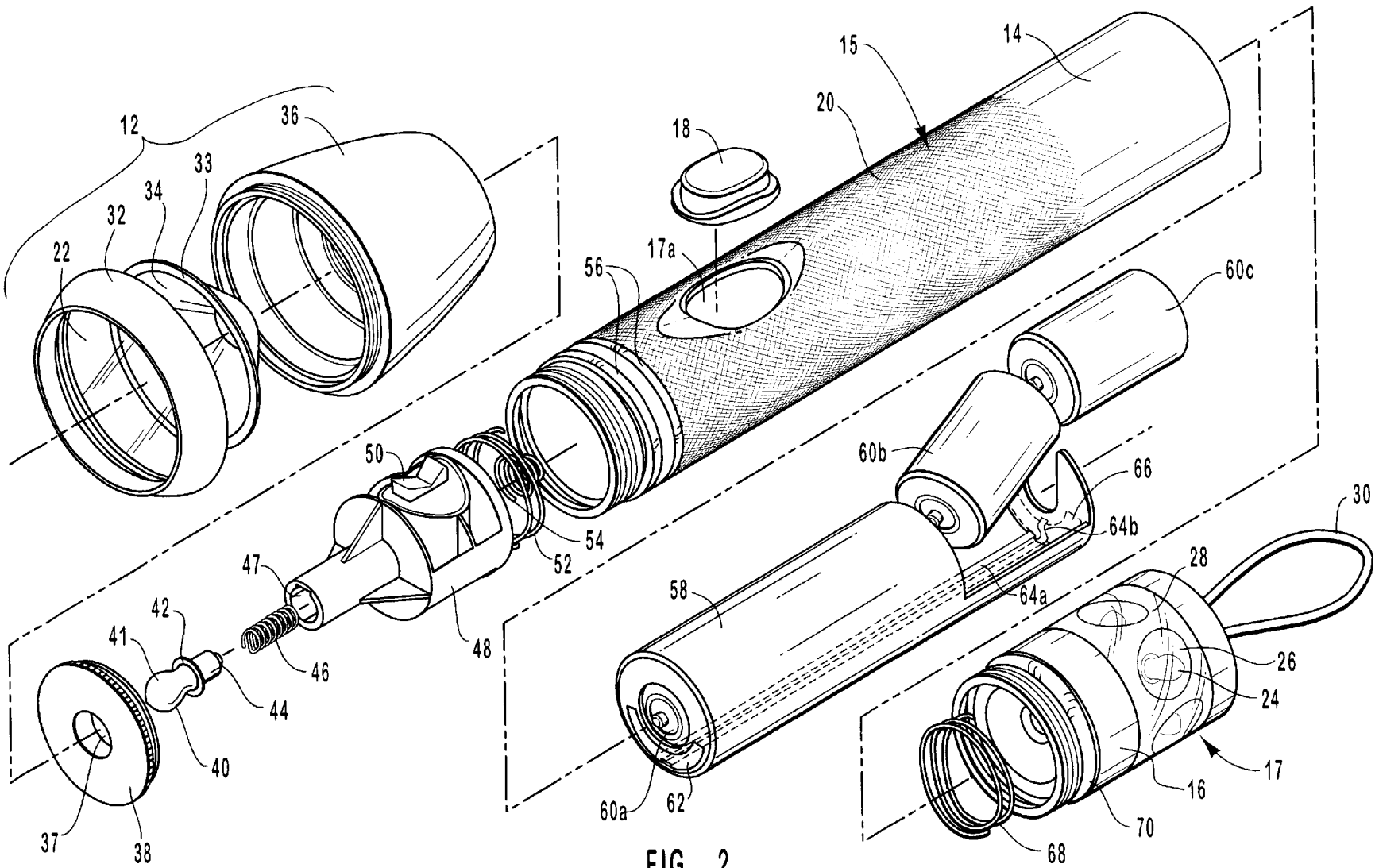
FIG. 2 illustrates an exploded view of the exemplary embodiment of FIG. 1.

With reference now to FIG. 2, an exploded view is provided of the exemplary embodiment of FIG. 1. Head module 12 comprises a cap 32, a lens 22, a parabolic reflector 34, and a body 36. Housing portion 13 (See FIG. 1) may be comprised of body 36, or body 36 and cap 32, and lens 22, for example. Cap 32 is threadedly coupled to or decoupled from the body 36. When cap 32 and body 36 are threadedly coupled, a portion of the body forces an outer rim 33 of parabolic reflector 34 against lens 22, which in turn is pinned against cap 32 when body 36 and cap 32 are coupled. Furthermore, head module 12 may comprise an o-ring (not shown) that resides between cap 32 and body 36 to prevent moisture from entering into head module 12. The use of o-rings further causes the flashlight to withstand shock. While FIG. 2 illustrates cap 32 as being capable of being threadedly coupled to body 36, other manners exist to couple cap 32 to body 36, as will be appreciated by those skilled in the art.

Head module 12 is threadedly coupled to hollow elongate housing portion 15 of handle module 14, which generally surrounds a conductive plate 38, a portion of a light source 40, a switching mechanism 48 having a switch 50, various springs, and a battery cartridge 58 that holds one or more batteries 60 in series. Switching mechanism 48 is fastened to reside within elongate handle module 14 so as to allow toggle switch 50 to be exposed at aperture 17*a* in housing portion 15. As provided above, while FIG. 2 illustrates switch 50 as a toggle switch, those familiar with the art will recognize that other switches may be used, such as an electronic switch, a button, a lever, a dial, or other mechanism that opens, closes or changes the connections of the electrical circuit. A covering, such as the rubber cap illustrated as button 18, may be installed at aperture 17*a* so as to cover switch 50. Button 18 allows a user to employ switch 50 to actuate or deactuate a light source and enhance the overall appearance of the flashlight.

Light source 40 is coupled to the switching mechanism 48. A contact point 44 of the light source 40 is connected to a contact point (not shown) in aperture 47 of the switching mechanism 48 to allow the switch 50 to actuate or deactuate light source 40, as will be further explained below. A spring 46, interposed between the light source 40 and the switching mechanism 48, causes light source 40 to be electrically coupled to switching mechanism 48. Conductive plate 38 is threadedly coupled to the inside wall of handle module 14 to place the light source 40, the spring 46 and the switching mechanism 48 in electrical contact. Furthermore, conductive plate 38 provides an electrical contact between the light source 40 and the housing portion 15 of handle module 14 when the housing comprises a conductive material, as will be further explained in the disclosure below corresponding to the schematic of FIG. 4. An aperture 37 is located in the center of plate 38 to allow the head 41 of light source 40 to extend therethrough.

Head module 12 is threadedly coupled to cylindrical housing portion 15 of handle module 14. As such, head 41 of light source 40 may reside inside of the head module 12 so that light emitted from light source 40 is reflected by reflector 34 and emitted out of head module 12 as a beam of light through lens 22 when light source 40 is actuated. One or more o-rings are positioned between head module 12 and handle module 14 to prevent moisture from entering into flashlight 10.

One or more batteries 60 provide power to the various light sources when the light sources are actuated. As illustrated in FIG. 2, a battery cartridge 58 holds one or more batteries 60 in series. The battery cartridge 58 comprises a non-conductive material, such as plastic. Battery cartridge 58 further comprises contact points 62 and 66 and conductive ribbons 64*a* and 64*b*. Contact points 62 and 66 and conductive ribbons comprise a conductive material, such as copper or another metal. The use of contact points 62 and 66 and conductive ribbons 64 will be further explained in the disclosure below corresponding to the schematic of FIG. 3. Battery cartridge 54 is removably inserted into handle module 14 and provides an aperture at a first end to enable the positive end of the batteries 60 to form a contact with the switching mechanism through the use of inner spring 54. The negative end of the series of batteries is in contact with the conductive ribbon 64*b*.

In the illustrated embodiment, tail module 16 comprises housing portion 17 and one or more light sources 24 that are oriented radially in relation to housing portion 17. A reflector, such as reflector 26, is located about or near each light source within housing 17, such as light source 24, to assist in providing generally radial illumination. Reflectors 26 may have a parabolic shape, for example. In the embodiment of FIG. 2, housing 17 comprises a tubular shaped protective lens 28 comprising a transparent or semitransparent material, such as a polycarbonate lens, which is provided over the various light sources for protection. Tail module 16 is threadedly coupled to handle module 14 and an o-ring 70 may be placed therebetween to prevent moisture from entering. A spring 68 provides a contact between tail module 16 and contact point 66. Another contact is made between tail module 16 and handle module 14, as will be further explained below. A hanger 30 may be coupled to the end of tail module 16 to enable the flashlight to be suspended from a hook, branch, etc.

While the embodiment illustrated in FIGS. 1 and 2 comprise the components disclosed above, those familiar with the art understand that other components may be utilized or substituted. Also, while the disclosure above refers to components that are threadedly coupled, those skilled in the art will appreciate that other manners exist that couple components together, such as by clipping, snapping, bonding, etc. Furthermore, embodiments of the present invention embrace a variety of different configurations in the order of coupling the head module, tail module and handle, such as, for example, a tail module that provides radial illumination interposed between a head module and a handle.

Figure 3:
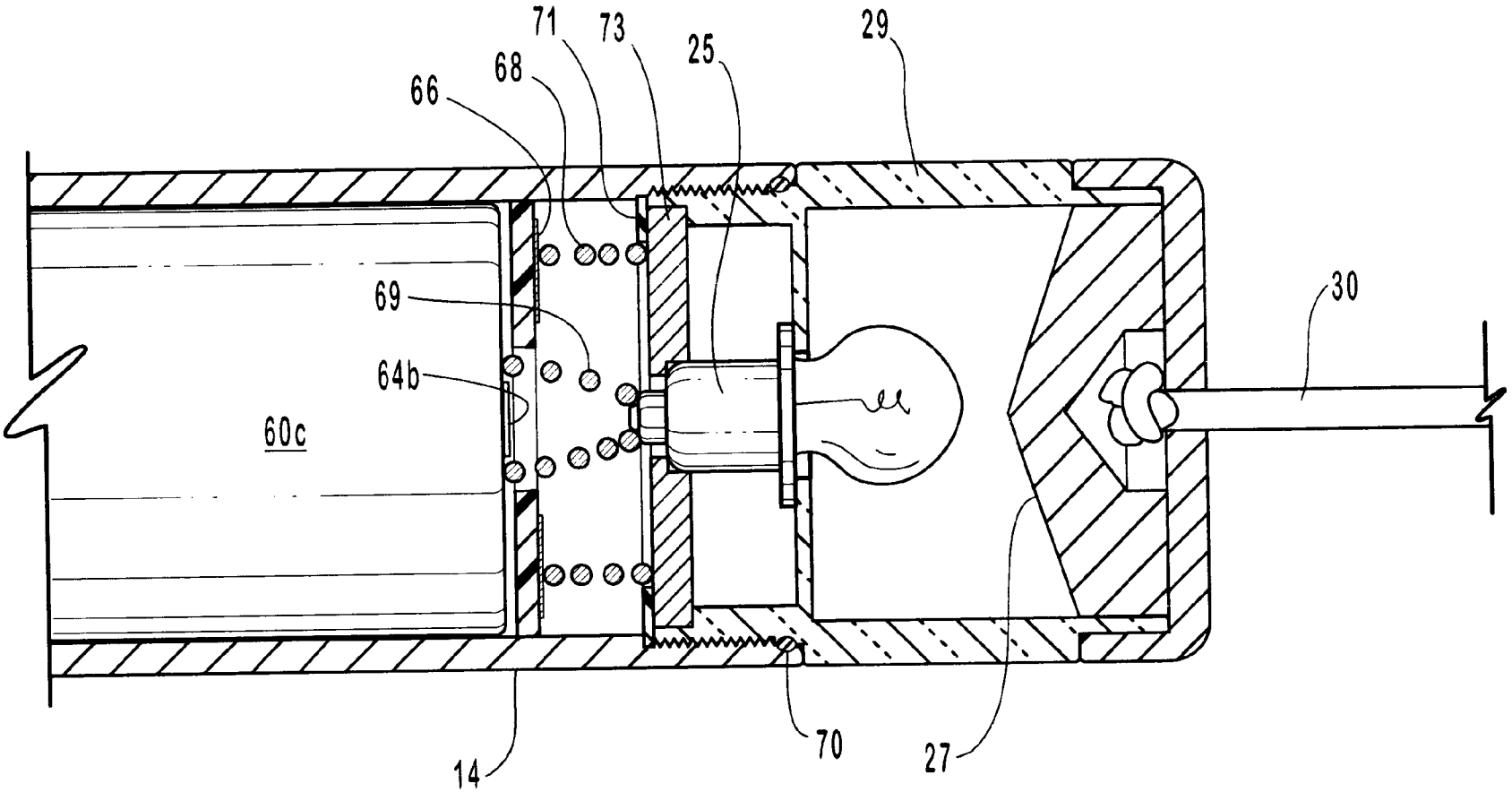
FIG. 3 illustrates an alternative embodiment of the tail module.

With reference now to FIG. 3, an illustration is provided of an alternative embodiment of the tail module. In FIG. 3, the tail module comprises a light source 25 and a diffusing reflector 27 (shown in cross sectional view) to provide generally radial illumination with respect to the tail module. The reflector 27 diffuses the illumination emitted from light source 25. The reflector may comprise a variety of different materials that may be used to diffuse a direct beam of light.

A housing portion comprising a protective lens 29 comprising a transparent or semi-transparent material, such as a polycarbonate lens, is also provided. The tail module is threadedly coupled to handle module 14 of FIG. 2 and an o-ring 70 may be placed therebetween to prevent moisture from entering. A spring 68 provides a contact between contact point 66 (also illustrated in FIG. 2) and contact point 73 of the tail module. An insulator 71 prevents spring 68 from being in electrical contact with housing portion 15 of handle module 14. Contact point 73 and light source 25 are electrically coupled. Another electrical contact is formed with light source 25 by inner spring 69, which electrically couples light source 25 to the negative end of battery 60*c*.

As such, in accordance with the embodiment illustrated in FIG. 3, when light source 25 is actuated, illumination is emitted from light source 25. At least a portion of the illumination is diffused by reflector 27. Thus, the combination of a light source 25 and a reflector 27 that diffuses at least a portion of the light, generally radial illumination is provided in relation to the tail module. Furthermore, light source 25 may be interchangeable with light source 40 of FIG. 2 such that the user may use light source 25 in place of light source 40 if light source 40 burns out, or vice versa. While FIG. 3 illustrates one light source 25, embodiments of the present invention embrace a combination of more than one light source and one or more diffusing reflectors.

Figure 4:
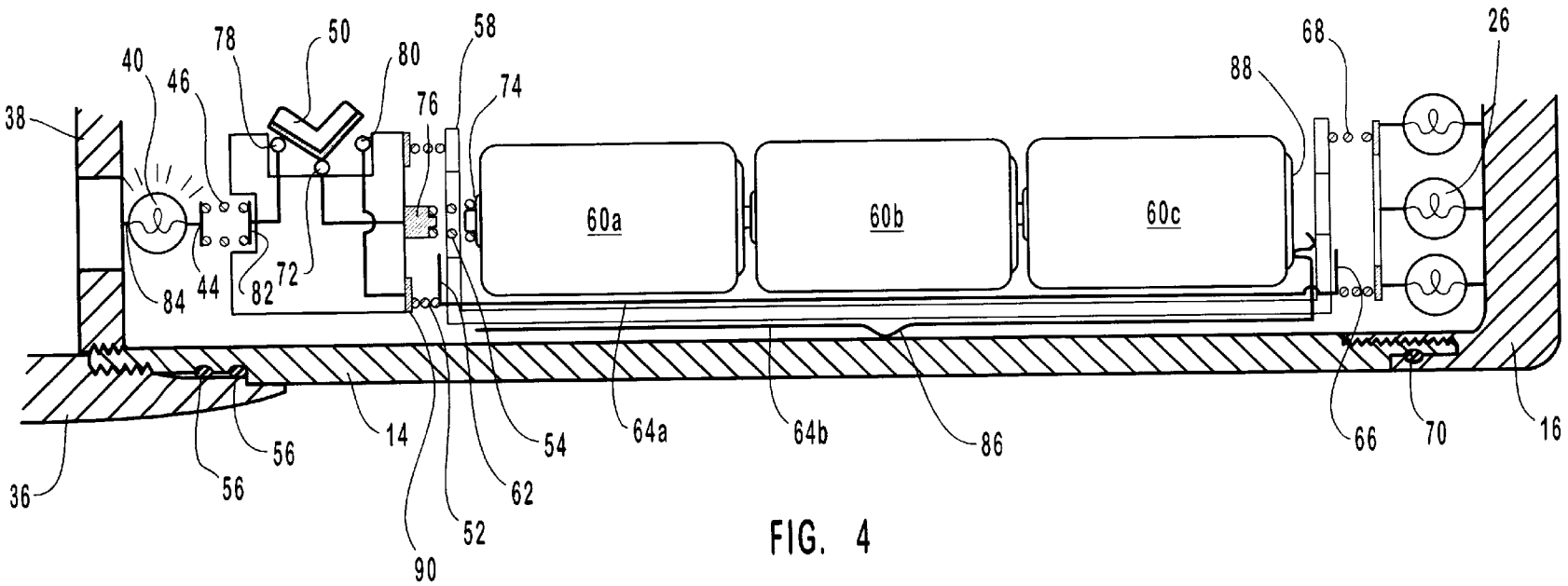
FIG. 4 illustrates a schematic representation of the exemplary embodiment of FIG. 1.

With reference now to FIG. 4, an illustration is provided of a schematic representation of the exemplary embodiment of FIG. 11. While FIG. 4 and the following discussion are intended to provide a brief, general description of an exemplary schematic representation of an electrical circuit that provides the features of the present invention, those skilled in the art will appreciate that the invention may be practiced using a variety of different components and/or circuit configurations to implement the features of the present invention.

In FIG. 4, toggle switch 50 is continuously connected to a middle contact point 72, which is electrically coupled to a positive end 74 of one or more batteries 60. The positive end 74 is in electrical contact with inner spring 54, which is in electrical contact with a contact point 76 of the switching mechanism that is electrically coupled to the middle contact point 72.

In the illustrated embodiment of FIG. 4, a user may place toggle switch 50 in one of three positions: (1) in contact with a forward contact point 78 to actuate a light source 40 in the head module and to deactuate the one or more light sources 26 in the tail module; (2) in contact with a rear contact point 80 to actuate the one or more light sources 26 in the tail module and to deactuate the light source 40 in the head module; and (3) only in contact with middle contact point 72, so as to deactuate the light source 40 in the head module and the one or more light sources 26 in the tail module. Other embodiments of the present invention embrace other switching orientations so as to, for example, actuate the light sources at both the head module and tail module in order to emit light from both modules simultaneously, to actuate each of the light sources at the tail module individually, etc.

Therefore, as illustrated in FIG. 4, when a user places toggle switch 50 in electrical contact with forward contact point 78 an electrical circuit is closed to thereby actuate light source 40. As provided above, positive end 74 of the series of batteries 60 is electrically coupled to inner spring 54, which is electrically connected to contact point 76, which is electrically wired to middle contact point 72. When toggle switch 50 is switched forward, middle contact point 72 is electrically coupled to forward contact point 78, which is electrically wired to contact point 82. Contact point 82 is electrically coupled to contact point 44 of light source 40 by spring 46, which resides therebetween. As provided above, a contact ring 42 (illustrated in FIG. 2) of light source 40 is coupled to plate 38 to provide an electrical contact at node 84. When plate 38 is coupled to handle module 14, plate 38 and handle module 14 are electrically coupled since housing portion 15 of handle module 14 comprises a conductive material, such as aluminum. A protrusion 86 in conductive ribbon 64*b* is in electrical contact with handle module 14 and with the negative end 88 of the series of batteries 60, thereby completing the circuit to actuate light source 40 at the head module.

Alternatively, as explained above, a user may place toggle switch 50 so as to be in electrical contact with both the middle contact point 72 and the rear contact point 80 so as to close a circuit that actuates the one or more light sources 26 at the tail module 16. As such, and as explained above, positive end 74 of the series of batteries 60 is electrically wired to inner spring 54, which is electrically connected to contact point 76, which is electrically wired to middle contact point 72. When toggle switch 50 is switched backward, the middle contact point 72 is electrically coupled to the rear contact point 80, which is electrically wired to contact point 90 of the switching mechanism. Contact point 90 of the switching mechanism and contact point 62 of the battery case are electrically coupled by an outer spring 52 that resides therebetween. As provided above, contact points 62 and 66 of the battery cartridge 58 (illustrated in FIG. 2) are electrically coupled via a conductive ribbon 64*a* that runs therebetween. Contact point 66 is electrically connected to the one or more light sources 26 at tail module 16 via a spring 68 that resides therebetween. The one or more light sources 26 are electrically coupled to the housing portion 17 of tail module 16, which comprises a conductive material so that when the tail module 16 is coupled to the housing portion 15 of handle module 14, tail module 16 is in electrical contact with handle module 14, which is in electrical contact with conductive ribbon 64*b* at protrusion 86. And, as provided above, conductive ribbon 64*b* is electrically coupled to the negative end 88 of the series of batteries 60, thereby completing the circuit to actuate the one or more light sources 26 at the tail module 16.

Alternatively, as provided above, when a user places toggle switch 50 to neither be in contact with forward contact point 78 nor rear contact point 80, the light source 40 at the head module and the one or more light sources 26 at the tail module are deactuated since both of the aforementioned electrical circuits are open circuits.

Figure 5:
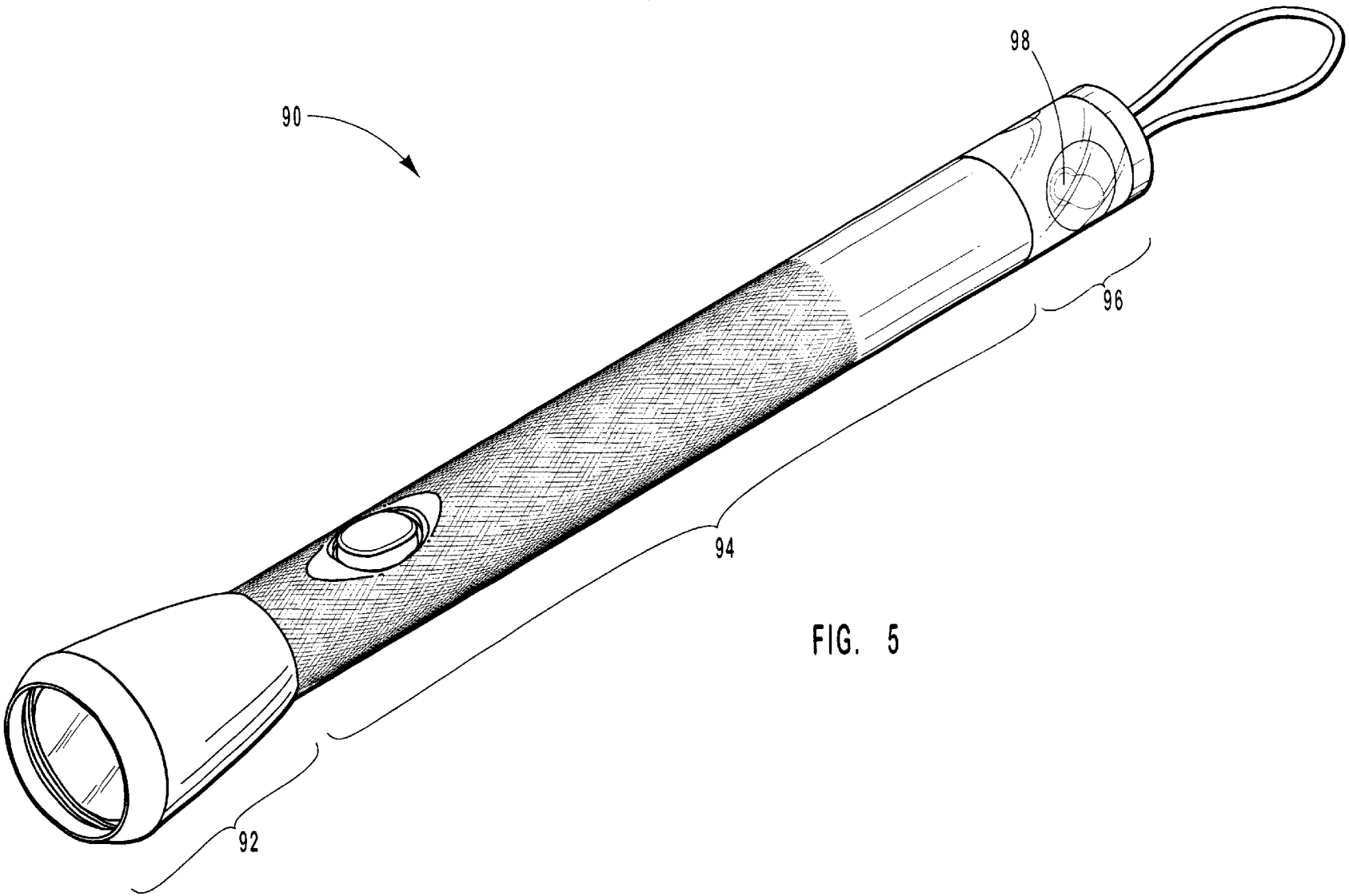
FIG. 5 illustrates a perspective view of another exemplary embodiment of the present invention.

FIG. 5 illustrates a perspective view of another exemplary embodiment of the present invention, illustrated as flashlight 90. While similar to flashlight 10 of FIG. 1, flashlight 90 comprises a head module 92, a tail module 96, and an elongate handle 94 interposed therebetween, the shape of flashlight 90 is narrower than flashlight 10 of FIG. 1. Furthermore, the number of light sources 98 at tail module 96 is reduced compared to the light sources illustrated in tail module 16 of FIG. 1. Therefore, as will be appreciated by those skilled in the art, embodiments of the present invention embrace a variety of different sizes, shapes and/or configurations that implement the features of the present invention.

As shown in the one embodiment of the present invention, the first light source and the second light source are located on opposing sides of the power source (e.g., the portable batteries). One advantage to this dynamic is that when the flashlight is suspended from a tent or other structure, or mounted on a surface with the tail module in the upper position, the light emitting portion of the flashlight is raised about the ground or surface to increase the span of the illumination. However a variety of other embodiments of the present invention are available.

Thus, the present invention relates to an illumination device having multiple light sources that may be actuated by a user. More specifically, the present invention is directed to a flashlight having a first light source located at or near a first end, a second light source located at or near a second end to provide radial illumination, and a switching mechanism for actuating or deactuating one or more of the light sources. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A portable, hand-held flashlight configured to provide generally radial illumination, the flashlight comprising:

a power source;

means for containing the power source;

means electrically coupled to the power source for providing generally radial illumination, wherein the means for providing generally radial illumination comprises means for diffusing the illumination, the means for diffusing the illumination comprising a diffusing reflector configured such that light is reflected away from peripheral surfaces of the diffusing reflector such that the portable, hand-held flashlight emits generally radial illumination, wherein the means for providing generally radial illumination is located at a first portion of the means for containing; and wherein the flashlight further comprises:

means located at a second portion of the means for containing for providing illumination.

2. An illumination device as recited in claim 1, wherein the flashlight comprises an electrical circuit electrically coupled to the power source and the means for providing generally radial illumination, the electrical circuit comprising means for selectively actuating at least one of:

a. the means for providing generally radial illumination at the first portion of the means for containing; and b. the means for providing illumination at the second portion of the means for containing.

3. An illumination device as recited in claim 2, wherein the means for selectively actuating further comprises means for deactuating at least one of:

a. the means for providing generally radial illumination at a first portion of the means for containing; and b. the means for providing illumination at the second portion of the means for containing.

4. An illumination device as recited in claim 3, wherein the means for providing illumination comprises means for concentrating the illumination at the second portion of the means for containing.

5. An illumination device as recited in claim 4, wherein the means for concentrating the illumination comprises a parabolic reflector that provides a generally linear beam of light from the second portion of the means for containing when the means for providing illumination is actuated.

6. An illumination device as recited in claim 5, wherein the means for providing generally radial illumination comprises a first light source and the means for providing illumination comprises a second light source, and wherein the first and second light sources are interchangeable.

7. An illumination device as recited in claim 3, further comprising means for suspending the flashlight.

8. An illumination device as recited in claim 7, wherein the means for suspending is coupled to the first portion of the means for containing.

9. An illumination device as recited in claim 3, wherein the means for selectively actuating comprises an electronic switch.

10. An illumination device as recited in claim 3, wherein the first and second portions of the means for containing are removably coupled to a third portion of the means for containing.

11. An illumination device as recited in claim 10, wherein the means for selectively actuating is generally contained in the third portion of the means for containing.

12. An illumination device as recited in claim 1, wherein the means for containing comprises a housing configured to contain the power source and the means electrically coupled to the power source for providing generally radial illumination and wherein the diffusing reflector prevents linear illumination through the reflector.

13. An illumination device as recited in claim 1, wherein the means for diffusing comprises a diffusing reflector that is one of:

a. conically shaped; and b. wedge shaped.

14. A portable, hand-held flashlight configured to provide radial illumination, the flashlight comprising:

a power source;

a first light source electrically coupled to the power source, the first light source configured to provide illumination;

a flashlight housing configured to house the power source and the first light source;

a reflector housed by the housing, the reflector configured so as to diffuse the illumination of the first light source, the reflector configured such that light from the first light source is reflected away from peripheral surfaces of the diffusing reflector such that the portable, hand-held illumination flashlight emits generally radial illumination and a second light source housed by a different portion of the flashlight housing from the first light source.

15. A portable hand-held flashlight as recited in claim 14, further comprising:

a focusing reflector mounted in the flashlight housing so as to focus the light emitted from the second light source.

16. A portable, hand-held flashlight as recited in claim 15, wherein the diffusing reflector prevents linear illumination through the reflector.

17. A portable, hand-held flashlight as recited in claim 15, wherein light emitted from the second light source is emitted generally linearly and light emitted from the first light source is emitted generally radially.

18. A portable, hand-held flashlight system comprising:

a housing;

a first light source contained within the housing such that the flashlight is configured to provide generally linear illumination;

a second light source contained within the housing;

at least one reflector contained within the housing, wherein a combination of the second light source and the reflector provide generally radial illumination, wherein the reflector is a diffusing reflector that is configured such that light from the second light source is reflected away from peripheral surfaces of the diffusing reflector; and a power supply housed within the housing for selectively providing power to at least one of the first and second light sources.

19. A portable, hand-held flashlight system as recited in claim 18, further comprising a switch that selectively actuates at least one of:

(i) the first light source to provide a generally linear beam of light; and (ii) the second light source to provide the generally radial illumination.

20. A portable, hand-held flashlight system as recited in claim 19, wherein the first or second light sources is one of:

(i) a bulb;

(ii) a light emitting diode; and (iii) a laser.

21. A portable, hand-held flashlight system as recited in claim 18, wherein the first and second light sources are interchangeable.

22. A portable, hand-held flashlight system as recited in claim 18 wherein the diffusing reflector prevents linear illumination through the reflector.

23. A portable, hand-held flashlight system as recited in claim 18 further comprising a switch configured to selectively actuate the flashlight.

24. A portable, hand-held flashlight system as recited in claim 18, wherein a portion of the housing is interpositioned between first and second portions of the housing.

25. A portable, hand-held flashlight system as recited in claim 24, wherein the housing comprises a grip configured to be grasped by a user.

26. A portable, hand-held flashlight system as recited in claim 25, wherein radial illumination provided by the second light source is transverse to an axis of the grip.

27. A portable, hand-held flashlight system as recited in claim 23, wherein the housing further comprises a conductive material.

28. A portable, hand-held flashlight system as recited in claim 23, further comprising a hanger coupled to the housing.

29. A portable, hand-held flashlight system as recited in claim 28, wherein the hanger comprises a dynamic loop.

30. A portable, hand-held flashlight system comprising:

a housing:

a first light source contained within the housing, a second light source contained within the housing;

at least one reflector contained within the housing, wherein a combination of the second light source and the reflector provide generally radial illumination, wherein the reflector is a diffusing reflector that is configured such that light from the second light source is reflected away from peripheral surfaces of the diffusing reflector: and a power supply housed within the housing for selectively providing power to at least one of the first and second light sources.

wherein the power source comprises a cartridge that holds at least one battery.

31. A portable, hand-held flashlight system as recited in claim 30, wherein the cartridge comprises a non-conductive material, a first contact point at a first end of the cartridge, and a second contact point at a second end of the cartridge, and wherein the first and second contact points are electrically coupled.

32. A portable, hand-held flashlight comprising:

a housing portion;

a tail module coupled to the housing portion;

a diffusing reflector mounted within the tail module;

a light source contained within the tail module such that the light source emits generally radial illumination with respect to the tail module;

a power source for providing power to the light source, wherein the diffusing reflector is configured such that light from the light source is reflected away from peripheral surfaces of the diffusing reflector; and a second light source mounted in the housing portion, the second light source configured to receive power from the power source.

33. A flashlight as recited in claim 32, wherein the power source is located in:

(i) the tail module; or (ii) the housing portion and wherein the diffusing reflector prevents linear illumination through the reflector.

34. A flashlight as recited in claim 32, wherein the second light source mounted in the housing portion provides generally linear illumination.

35. A flashlight as recited in claim 34, further comprising a switching device that electrically couples at least one of the first and second light sources to the power source.

36. A flashlight as recited in claim 32, wherein a second reflector concentrates illumination.

37. A portable, hand-held flashlight as recited in claim 32, wherein the tail module is threadedly coupled to the housing portion.

38. A flashlight as recited in claim 32, wherein the tail module is removably coupled to the housing portion.

39. A handheld, portable flashlight that provides focused illumination from a first end and/or radial illumination from a second end, the flashlight comprising:

a portable, electrical circuit;

at least one battery electrically coupled to the portable electrical circuit;

a housing configured to contain the portable electrical circuit and the at least one battery;

a first light source at one end of the housing, the first light source being electrically coupled to the electrical circuit;

a first reflector positioned adjacent the first light source such that the combination of the first light source and the first reflector provides a generally linear illumination;

a second light source at an opposing end of the housing; and a second reflector positioned adjacent the second light source such that the combination of the second light source and the second reflector provides generally diffused illumination, such that the flashlight selectively provides generally linear and/or radial illumination, wherein the second reflector is configured such that light from the light source is reflected away from peripheral surfaces of the diffusing reflector and wherein the diffusing reflector prevents linear illumination through the second reflector.

40. A flashlight as recited in claim 39, wherein the first end of the flashlight can be selectively mounted on a support surface such that the second light source can provide generally radial illumination as the flashlight rests on the support surface.

* * * * *

UNITED STATES PATENT AND TRADEMARK OFFICE

CERTIFICATE OF CORRECTION

PATENT NO. : 6,623,140 B2
DATED : September 23, 2003
INVENTOR(S) : Watterson et al.

It is certified that error appears in the above-identified patent and that said Letters Patent is hereby corrected as shown below:

Title page,
Item [57], ABSTRACT,
Line 7, after "located" insert -- in --

Column 7,
Line 14, change "FIG. 11" to -- FIG. 1 --

Column 8,
Line 54, change "about" to -- above --

Signed and Sealed this

Third Day of February, 2004

JON W. DUDAS
*Acting Director of the United States Patent and Trademark Office*